United States Patent [19]

Kolt

[11] Patent Number: 4,466,402

[45] Date of Patent: Aug. 21, 1984

[54] AUTOMATIC SWITCH ASSEMBLY

[75] Inventor: Stanley Kolt, Mamaroneck, N.Y.

[73] Assignee: Leonard W. Suroff, Jericho, N.Y. ; a part interest

[21] Appl. No.: 532,401

[22] Filed: Sep. 15, 1983

[51] Int. Cl.[3] ..... F02B 77/08

[52] U.S. Cl. ..... 123/196 S; 123/198 DC; 184/6.4

[58] Field of Search ..... 123/196 S, 198 D, 198 DC; 184/6.4

[56] References Cited

U.S. PATENT DOCUMENTS

| | | | |
|---|---|---|---|
| 2,792,912 | 5/1957 | Kangas | 123/196 S |
| 2,836,164 | 5/1958 | Kinney | 123/196 S |
| 3,499,130 | 3/1970 | Norred | 184/6.4 |
| 4,256,069 | 3/1981 | Masuda et al. | 123/196 S |
| 4,299,307 | 11/1981 | Scott | 184/6.4 |

FOREIGN PATENT DOCUMENTS

| | | | |
|---|---|---|---|
| 39527 | 11/1901 | France | 123/196 S |
| 557262 | 8/1923 | France | 123/196 S |
| 619749 | 4/1927 | France | 123/196 S |
| 675681 | 2/1930 | France | 123/196 S |
| 698167 | 1/1931 | France | 123/196 S |
| 727488 | 6/1932 | France | 123/196 S |

*Primary Examiner*—Ira S. Lazarus

*Attorney, Agent, or Firm*—Leonard W. Suroff

[57] ABSTRACT

A pressure activated switch for use in series in the fluid flow path of a motor is disclosed, with the switch having a housing with a top end, a bottom end, and axially extending chamber extending between the ends with a vertically extending wall defining the periphery of the chamber. The chamber has an inlet port and an outlet port communicating therewith, with the ports in vertically spaced relationship to each other so as to obtain a flow of fluid from the motor between the ports, such that the level of fluid in the chamber is directly related to the level of fluid associated with the motor. A first electrical terminal extends from the bottom end into the chamber, with a second electrical terminal extending into the chamber through the wall, the terminals are adapted to be connected in the current starting path of the motor. An element is provided which moves with the level of fluid within the chamber. The element causes the engagement of the second electrical terminal with the first electrical terminal when the fluid in the chamber is at a level below which the motor should continue thereby completing a current path of a solenoid or relay which opens the current to the motor such that the motor in turn stops operating prior to any damage occurring thereto.

23 Claims, 4 Drawing Figures

AUTOMATIC SWITCH ASSEMBLY

BACKGROUND OF THE INVENTION

A safety system and switch for use therewith is disclosed, to safeguard diesel engines, gasoline engines, or the like and motors that have lubricating fluid such as oil therein which become damaged if not stopped in time when the lubricating oil therein falls below a certain minimum level therein.

There are various motors in use that become permanently damaged if the lubricating oil therein falls below a certain level causing the motor to overheat and seize. This problem generally arises by the failure to check the oil level in the motor on a timely basis or a leak developes unknown to the user. With the increasingly high cost of motors today it is ever more important to provide a simple and efficient device that automatically terminates the electric energy to power the motor when the oil level falls below the predetermined level. The present invention accomplishes this purpose.

OBJECTS OF THE INVENTION

An object of the present invention is to provide a safety system for terminating the current flow to a motor or engine, when the lubricating fluid therein is below a predetermined level.

Another object of the present invention is a new and novel pressure activated switch for use in series with the fluid flow path of a motor so as to automatically terminate the current to the motor when the fluid therein is below a preselected level.

Other objects and advantages of the present invention will become apparent as the disclosure proceeds.

SUMMARY OF THE INVENTION

The pressure activated switch for use in series in the lubricating fluid flow path of a motor is disclosed, with the switch having a housing with a top end, a bottom end, and axially extending chamber extending between the ends with a vertically extending wall defining the periphery of the chamber. The chamber has an inlet port and an outlet port communicating therewith, with the ports in vertically spaced relationship to each other so as to obtain a flow of fluid from the motor between the ports, such that the level of fluid in the chamber is directly related to the level of fluid associated with the motor.

A first electrical terminal extends from the bottom end into the chamber, with a second electrical terminal extending into the chamber through the wall, the terminals are adapted to be connected to complete relay contacts in series with the current starting path of the motor. An element carried by the first electrical terminal is provided which fluctuates with the level of fluid within the chamber. The element causes the second electrical terminal to contact the first electrical terminal when the fluid in the chamber is at a level below which the motor should continue to operate by completing a current path to a relay which opens the current to the motor such that the motor in turn stops operating prior to any damage occurring thereto.

The first electrical terminal extends upwardly from the bottom, and the second electrical terminal extends outwardly from the wall at substantially right angle to the first terminal. The first electrical terminal includes guide means associated therewith. The guide means includes a shaft adapted to receive thereon the element.

The element includes an upper surface, a lower surface, an outer surface extending intermediate the upper and lower surface, with the outer surface adapted to extend telescopically in the chamber. An aperture extends vertically between the upper and lower surfaces, such that the element will move on the shaft in the chamber depending on the level of fluid therein. The element helps complete the electrically conductive path between the first electrical terminal and the second terminal energizing a relay which opens. In this way the electrical energy to the motor is automatically terminated when the fluid in the motor and chamber falls below a certain level.

The second terminal includes a threaded element extending therefrom and adapted for mounting and grounding of the switch. The inlet port includes a fitting having an axial bore extending therethrough and adapted to receive a tube thereon for the fluid. The outlet port includes a fitting having an axial bore extending therethrough and adapted to receive a tube thereon for the fluid. The first and second electrical terminals are in sealed relation to the chamber. The fluid in the chamber is free to move into the engine for lubricating purposes.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
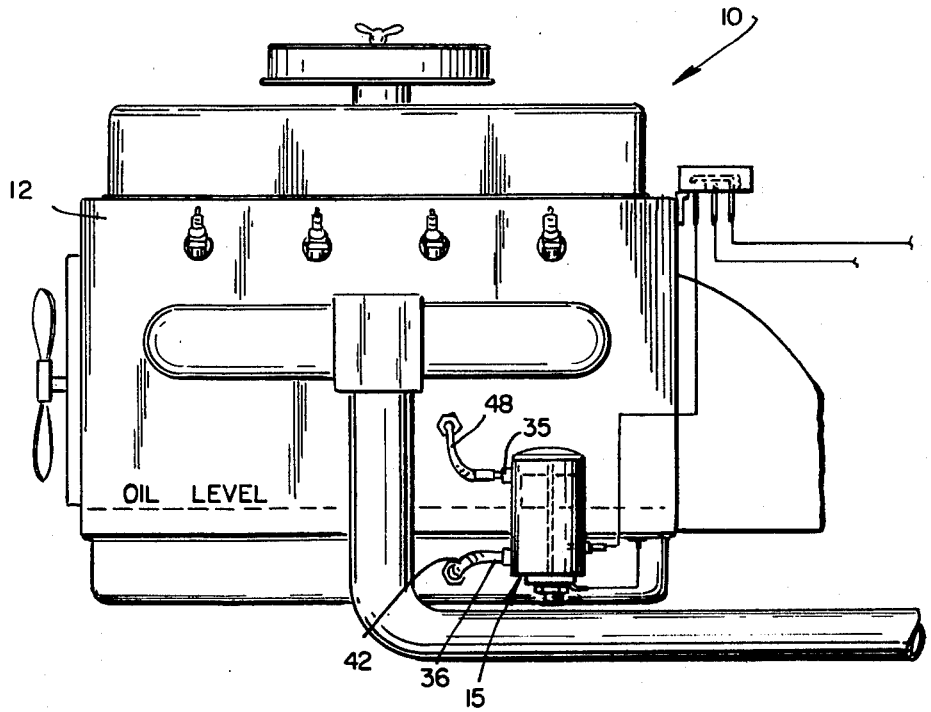
FIG. 1 is a plan view of a safety system in accordance with the present invention and illustrates the location of the switch mounted in reference to a motor.
Figure 2:
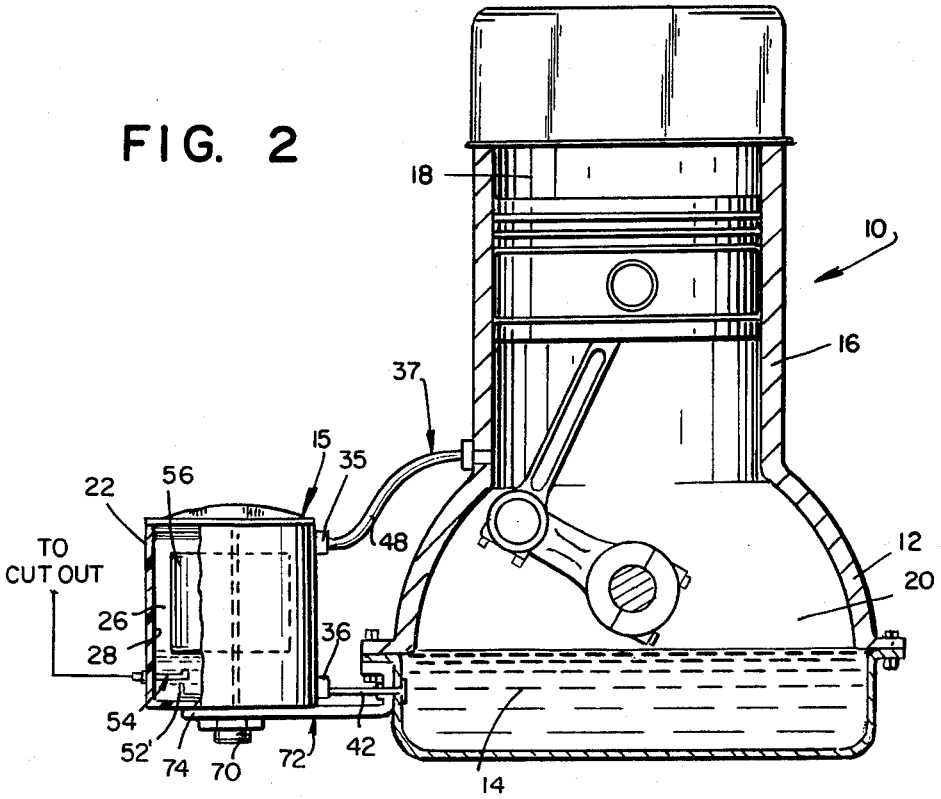
FIG. 2 is a sectional view of the motor and illustrates the switch in accordance with the present invention.
Figure 3:
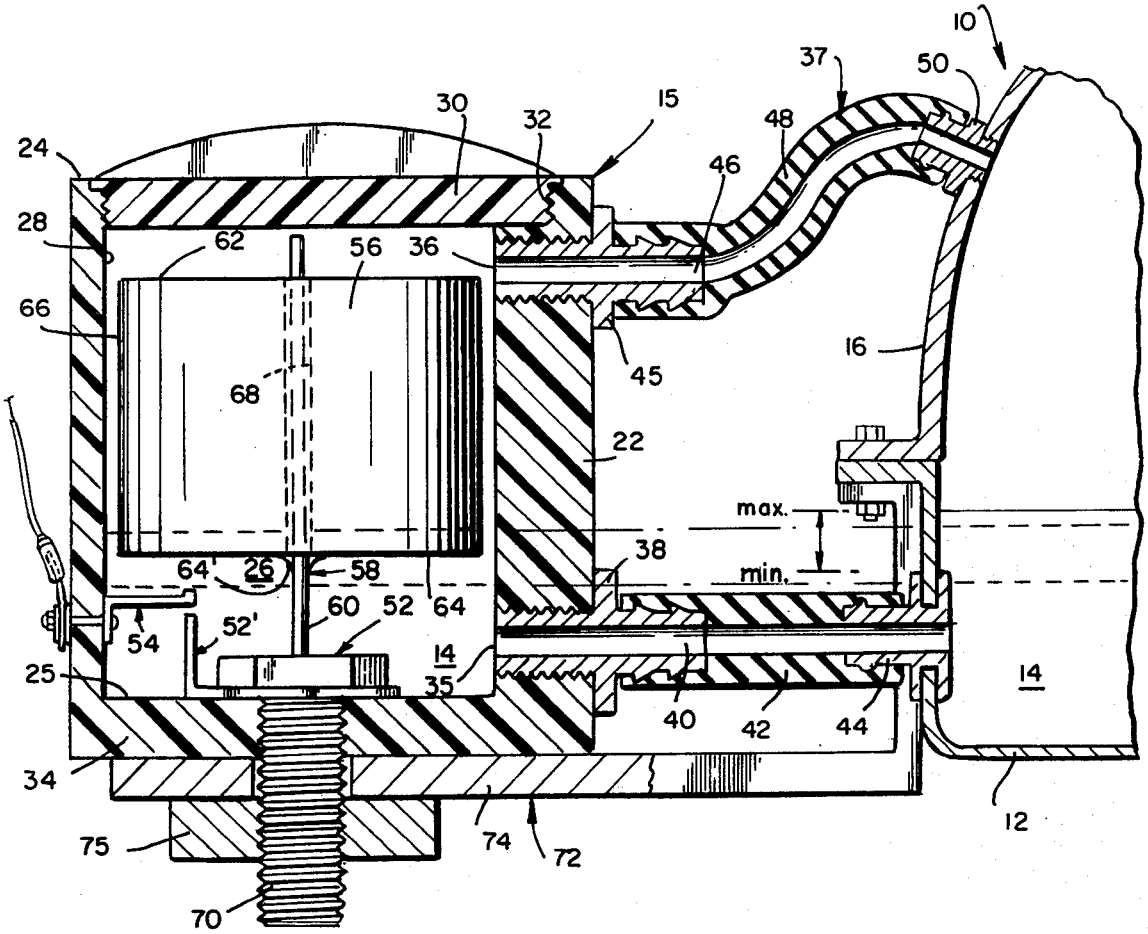
FIG. 3 is an enlarged sectional view of the switch in relation to the motor.

Referring to FIGS. 1–4 there is illustrated a safety system 10 for terminating the current flow to a motor 12 when the fluid 14 therein is below a predeterminated level as illustrated in FIG. 3. The system 10 includes a pressure activated switch 15 for use in series in the fluid flow path of the motor 12. The motor 12 includes a conventional casing 16 with a piston 18 and a cavity 20 in which the fluid 14 is contained. The fluid 14 acts as a lubricant for the motor 12 and the level should vary between the "Min" level and "Max" level as illustrated in FIG. 3. The switch 15 acts to terminate the electrical energy to the motor 12 when the fluid 14 in the chamber 20 falls below the "Min" level for any reason. It has been found that the primary cause of this happening is failure to check the fluid level from time to time, in turn causing the piston to bind and possibly damaging the entire motor 12.

The switch 15 includes housing 22 with a top end 24, a bottom end 25, and axially extending chamber 26 extending between the ends 24 and 25 respectively. The chamber 26 includes a vertically extending wall 28 defining the periphery of the chamber 26. The housing 22 includes a cover or hood 30 that may be removably secured to the housing 22 as by threads 32 as illustrated in FIG. 3. In addition the housing 22 includes a base or bottom wall 34. The housing 22 may be fabricated from a plastic or other non-conductive material. The chamber 26 has an inlet port 35 and an outlet port 36 communicating therewith, with the ports 35 and 36 vertically spaced relationship to each other so as to obtain a flow of fluid 14 from the motor 12 between the ports 35 and 36. In the manner the level of fluid 14 in the chamber 22 is directly related to the level of fluid 14 associated with the fluid 14 in the cavity or crankcase 20 in the motor 12.

The fluid in the chamber 26 is free to move into the motor 12 by coupling means 37 extending between the motor 12 and the switch 15. The coupling means 37 includes a fitting 38 having an axial bore 40 extending therethrough and coinciding with the inlet port 35 and adapted to receive a tube 42 thereon for the fluid 14. The tube 42 is connected by fitting 44 to the cavity 20. The outlet port 36 includes a fitting 45 having an axial bore 46 extending therethrough and adapted to receive a tube 48 thereon for the fluid 14 to flow therethrough. The tube 48 is connected by fitting 50 to the cavity 20 and the outlet port 36 coincides with the bore 46.

A first electrical terminal 52 extends from the bottom end 25 into the chamber 26, with a second electrical terminal 54 extending into the chamber 26 through the wall 22. The terminals 52 and 54 are adapted to be serially connected with the coil of relay 80 to the battery 85. The contacts 82 of the relay 80 are normally closed and connected in the current starting path 55 of the motor 12 illustrated in FIG. 4. An element 56 carried by the first electrical terminal 52 is provided and fluctuates with the level of fluid 14 within the chamber 26. The element 56 may be electrically conductive and engage the second electrical terminal 54 when the fluid 14 in the chamber 26 is at a level below which the motor 12 should continue to operate or element 56 may flex terminal 54 to come into contact with the extending portion 52' of terminal 52. When the fluid level 14 is below "Min" the element 56 will engage the second terminal 54 if it is conductive, will complete the current path to the coil of relay 80, via threaded element 70 and the mounting means 72 thereby opening contacts 82 and breaking the current path 55 to the motor 12, such that the motor 12 in turn stops operating prior to any damage occurring thereto.

The first electrical terminal 52 extends upwardly from the bottom 25, and the second electrical terminal 54 extends outwardly from the wall 22 at substantially right angle to the first terminal. The first electrical terminal 52 includes guide means 58 associated therewith. The guide means 58 includes a metallic shaft 60 adapted to receive thereon the element 56. The element 56 includes an upper surface 62, a lower surface 64, an outer surface 66 extending intermediate the upper surface 62 and lower surface 64, with the outer surface 66 adapted to extend telescopically in the chamber 26. An aperture 68 extends vertically between the upper surface 62 and lower surface 64, such that the element 56 will move on the shaft 60 in the chamber 26 depending on the level of fluid 14 therein. The lower surface 64, the aperture 68, and the shaft 60 being of a conductive material to provide an electrically conductive path between the first terminal 52 and the second terminal 54. The lower surface 64 may be provided with electrically conductive wiper arms 64' in intimate contact with shaft 60 to insure good electrical contact therewith. In this way the electrical energy to the motor 12 is automatically terminated with the fluid 14 in the motor 12 and the chamber 26 falls below a certain level.

The first terminal 52 includes a threaded element 70 extending therefrom and adapted for mounting and grounding of the switch 15. The first terminal 52 and the second terminal 54 are both mounted in sealed relation to the chamber 26.

Mounting means 72 is provided to retain the switch 15 in fixed relationship to the motor 12 and at a proper level. The mounting means 72 may be coupled to the motor or some other part of the apparatus or vehicle that the motor forms a part thereof. The mounting means 72 may include a bracket 74 on which the switch 15 is supported. The stud 70 may extend through the bracket 74 and a nut 75 secures the stud 70 and in turn switch 15 in fixed mounted position. One end of the bracket 74, which can be fabricated of metallic material is joined to the casing 16 and acts as the ground as well.

Figure 4:
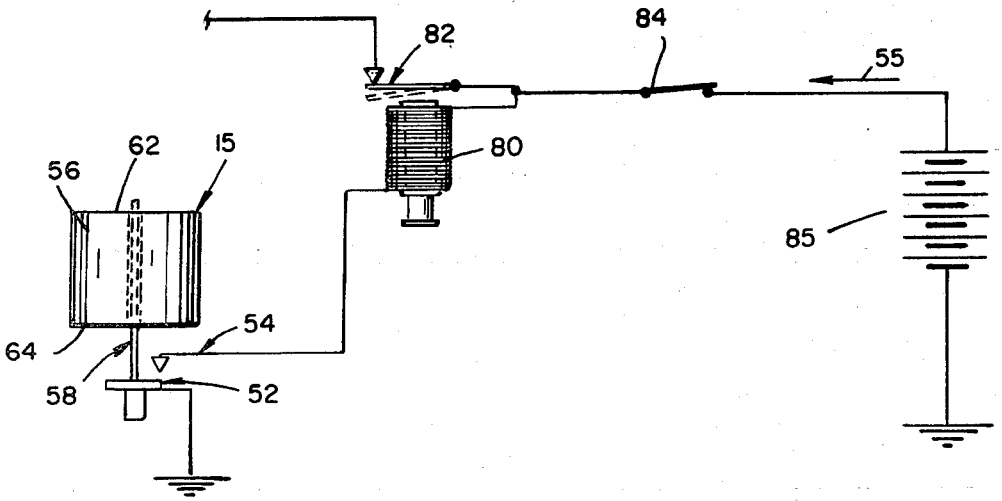
FIG. 4 is an schematic circuit diagram illustrating the arrangement of the components associated with the motor and the manner in which the switch operates to control same.

FIG. 4 illustrates the switch 15 as it forms a conductive path between the terminals 52 and 54. When the element 56 engages terminal 54 the current path to the relay 80 is completed, engaging it and thereby opening contacts 82 and interrupting the current flow to the magnetic ignition switch 84. This prevents a flow of current from battery 85 to the magnetic ignition causing the motor 12 to cease operating. When the fluid level is raised the element 56 floats up to open the circuit permitting relay 80 to return to its normally closed position closing contacts 82 re-establishing the current path.

Although an illustrative embodiment of the invention has been described in detail herein with references to the accompanying drawings, it is to be understood that the invention is not limited to the precise embodiments, and that various changes and modifications may be effected therein without departing from the scope or spirit of the invention.

I claim:

1. A pressure activated switch for use in series in the lubricating fluid flow path of a motor, comprising:

A. a housing having a top end and a bottom end with an axially extending chamber extending between said ends and a vertically extending wall defining the periphery of said chamber, B. an inlet port communicating with said chamber, C. an outlet port communicating with said chamber in vertically spaced relationship to said inlet port so as to obtain a flow of fluid from the motor between said ports, such that the level of fluid in said chamber is directly related to the level of fluid associated with the motor, D. a first electrical terminal extending from said bottom end into said chamber, E. a second electrical terminal extending into said chamber, F. element means carried by said first electrical terminal and fluctuating with the level of fluid within said chamber, said element means completing a current path between said first and second electrical terminals when the fluid in said chamber is at a level below which the motor should continue to operate, and G. means serially connected in said current starting path of said motor, said means normally completing said current starting path, and being responsive to said completing of a current path between said first and second terminals, and upon said completing of said path between said first and second terminals, opening said current starting motor path causing said motor to stop operating.

2. A pressure activated switch in accordance with claim 1, wherein said first electrical terminal extends upwardly from said bottom.

3. A pressure activated switch in accordance with claim 1, wherein said second electrical terminal extends outwardly from said wall.

4. A pressure activated switch in accordance with claim 1, wherein said first electrical terminal includes guide means associated therewith.

5. A pressure activated switch in accordance with claim 4, wherein said guide means includes a shaft adapted to receive thereon said element.

6. A pressure activated switch in accordance with claim 5, wherein said element includes:

a. an upper surface,
b. a lower surface,
c. an outer surface extending intermediate said upper and lower surface,
d. said outer surface adapted to extend telescopically in said chamber,
e. an aperture extending vertically between said upper and lower surfaces, such that said element will move in said chamber depending on the level of fluid therein, and
f. said lower surface and said aperture being of a conductive material to provide an electrically conductive path between said first terminal and said second terminal.

7. a pressure activated switch in accordance with claim 6, further including electrically conductive contact arms disposed on said conductive surface and in intimate contact with said guide means.

8. A pressure activated switch in accordance with claim 1, wherein said second terminal includes a threaded element extending therefrom and adapted for mounting and grounding of said switch.

9. A pressure activated switch in accordance with claim 1, wherein said inlet port includes a fitting having an axial bore extending therethrough and adapted to receive a tube thereon for the fluid.

10. A pressure activated switch in accordance with claim 1, wherein said outlet port includes a fitting having an axial bore extending therethrough and adapted to receive a tube thereon for the fluid.

11. A pressure activated switch in accordance with claim 1, wherein said first and second electrical terminals are in sealed relation to said chamber.

12. A pressure activated switch in accordance with claim 1, wherein said element means causes said first and second terminals to come into intimate contact when said oil level is below said motor operating level.

13. A safety system for terminating the current flow to a motor when the lubricating fluid therein is below a predetermined level, said system comprising:

A. a motor,
B. a pressure activated switch for use in series in the lubricating fluid flow path of said motor, said switch comprises:
(1) a housing having a top end and a bottom end with an axially extending chamber extending between said ends and a vertically extending wall defining the periphery of said chamber.
(2) an inlet port communicating with said chamber,
(3) an outlet port communicating with said chamber in vertically spaced relationship to said inlet port so as to obtain a flow of fluid from said motor between said ports, such that the level of fluid in said chamber is directly related to the level of fluid associated with said motor,
(4) a first electrical terminal extending from said bottom end into said chamber,
(5) a second electrical terminal extending into said chamber,
C. electrical circuit means coupled to said motor, said circuit means being responsive to said first and second terminals completing a current path when said lubricating fluid is below a predetermined level to open said current starting path of said motor to cause it to stop operating.

14. A safety system in accordance with claim 13, wherein said first electrical terminal extends upwardly from said bottom.

15. A safety system in accordance with claim 13, wherein said second electrical terminal extends outwardly from said wall.

16. A safety system in accordance with claim 13, wherein said first electrical terminal includes guide means associated therewith.

17. A safety system in accordance with claim 16, wherein said guide means includes a shaft adapted to receive thereon said element.

18. A safety system in accordance with claim 13, wherein said switch further includes a conductive element carried by said first terminal and fluctuating with the level of lubricating fluid within said chamber, said conductive element completing the current path between said first and second terminals when said lubricating fluid is below a predetermined level.

19. A safety system in accordance with claim 17, wherein said element includes:

a. an upper surface,
b. a lower surface,
c. an outer surface extending intermediate said upper and lower surface,
d. said outer surface adapted to extend telescopically in said chamber, and
e. an aperture extending vertically between said upper and lower surfaces, such that said element will move in said chamber depending on the level of fluid therein, and
f. said lower surface and said aperture being of a conductive material to provide an electrically conductive path between said first terminal and said second terminal.

20. A safety system in accordance with claim 13, wherein said second terminal includes a threaded element extending therefrom and adapted for mounting and grounding of said switch.

21. A safety system in accordance with claim 13, whrein said inlet port and said outlet port each include a fitting having an axial bore extending therethrough and adapted to receive a tube thereon for the fluid.

22. A safety system in accordance with claim 13, whrein said first and second electrical terminals are in sealed relation to said chamber.

23. A safety system in accordance with claim 13, including mounting means for retaining said switch in fixed position relative to said motor so as to have a movement of said element that is directly proportional to the level of fluid in said motor.

* * * * *